United States Patent [19]

Holmström

[11] Patent Number: 4,643,094

[45] Date of Patent: Feb. 17, 1987

[54] PRINTING PLATE FOR OFFSET PRINTING

[75] Inventor: Hakan Holmström, Löberöd, Sweden

[73] Assignee: Tetra Pak International AB, Lund, Sweden

[21] Appl. No.: 800,773

[22] Filed: Nov. 22, 1985

[30] Foreign Application Priority Data

Dec. 5, 1984 [SE] Sweden ..... 8406157

[51] Int. Cl.[4] ..... B41N 1/10

[52] U.S. Cl. ..... 101/401.1; 101/415.1

[58] Field of Search ..... 101/401.1, 415.1

[56] References Cited

U.S. PATENT DOCUMENTS

| | | | |
|---|---|---|---|
| 2,907,274 | 10/1959 | Taylor | 101/401.1 |
| 3,288,063 | 11/1966 | Bungay, Jr. | 101/401.1 |
| 3,335,663 | 8/1967 | Harenza | 101/415.1 |
| 3,568,595 | 3/1971 | Bunting | 101/401.1 |

FOREIGN PATENT DOCUMENTS

| | | | |
|---|---|---|---|
| 2528008 | 1/1976 | Fed. Rep. of Germany | 101/415.1 |
| 124858 | 7/1984 | Japan | 101/415.1 |

*Primary Examiner*—E. H. Eickholt

*Attorney, Agent, or Firm*—Burns, Doane, Swecker & Mathis

[57] ABSTRACT

The invention relates to a printing plate for offset printing comprising a number of printing patterns, having similar outer contours, which are located on the printing plate parallel to one another and adjoining one another but displaced in longitudinal direction in relation to one another. The printing plate is made in one piece with a width which corresponds with the combined width of the individual printing patterns and the printing plate is provided along its front edge and its rear edge with a stepped edge contour. The printing plate is arranged around a carrier cylinder which is fully surrounded by the printing plate, parts of the printing plate being received in a holding device arranged within the contour of the carrier cylinder.

8 Claims, 5 Drawing Figures

PRINTING PLATE FOR OFFSET PRINTING

FIELD OF THE INVENTION

The present invention relates to printing plates for offset printing generally and more particularly to printing plates for offset printing comprising a number of printing patterns, preferably alike in their outer contour, which are located on the printing plate parallel to one another and adjoining one another but displaced in longitudinal direction in relation to one another. The invention also relates to a printing cylinder comprising a carrier cylinder which is provided with such a printing plate.

BACKGROUND AND SUMMARY OF THE INVENTION

In the printing of blanks for packing containers, for example, material webs of paper or cardboard are used which are wide enough for a number of package blanks to be arranged side by side. The printing of such a wide web naturally brings with it an increased capacity and improved economy. Because package blanks in particular frequently are provided with lugs and thus do not have a straight edge contour, it is necessary in order to avoid wastage to displace the blanks in relation to one another so that a minimum of wastage is obtained. Hence it is endeavoured to displace the blanks so in relation to one another that a projecting lug from one blank fits into a corresponding recess in the adjoining blank and, since the blanks are identical, it is often possible by mutual displacement of the blank placements to achieve a production of blanks completely free of wastage or, in any case, presenting a minimum of wastage. This implies though, that the printing plates for printing of the blanks have to be displaced in relation to one another as the print has to be adapted to the placing of the blank.

This problem has been solved previously in such a manner that a number of separate printing plates were mounted on a carrier cylinder with a mutual displacement corresponding to the desired displacement of the pattern on the printed web. This printing plate mounting work is very demanding and time-consuming, since the individual printing plates have to be placed with very great precision in relation to one another which, among other things, requires exceptional professional skill in the person carrying out the mounting of the printing plates on the carrier cylinder. This procedure also has given rise to large quantities of material having to be rejected because of insufficient precision in the mounting of the printing plates. The present invention proposes a method to avoid these difficulties and is characterised in that the printing plate is made in one piece with a width which corresponds to the combined width of the individual printing patterns, and that the printing plate is provided along both its front and rear edges with a stepped edge cutting so as to form a number of substantially rectangular coherent parts, each having a length corresponding to, or slightly exceeding, the length of a printing pattern. The invention is also characterized by a printing cylinder comprising a carrier cylinder, each of the said printing plate parts being arranged around and surrounding the carrier cylinder, the front edge of the printing plate parts being accommodated in a holding device arranged inside the contour of the carrier cylinder this holding device presenting a plane top side which is located level with the surface of the carrier cylinder and that the rear edge of the printing plate parts is fixed to the plane top side of said holding device.

BRIEF DESCRIPTION OF THE DRAWING

A preferred embodiment of the present invention will be described with reference to the drawing, wherein.

Offset printing plates are manufactured most frequently with the help of a photographic process in the course of which a text and decoration present on a drawing or film is transferred to the printing plate surface which subsequently is etched or treated in some other manner so that light-exposed parts are removed. This can be done, for example, in that the surface of the printing plate has a coating which after exposure to light undergoes a chemical change so that it can be removed whilst unexposed portions remain intact.

Figure 1:
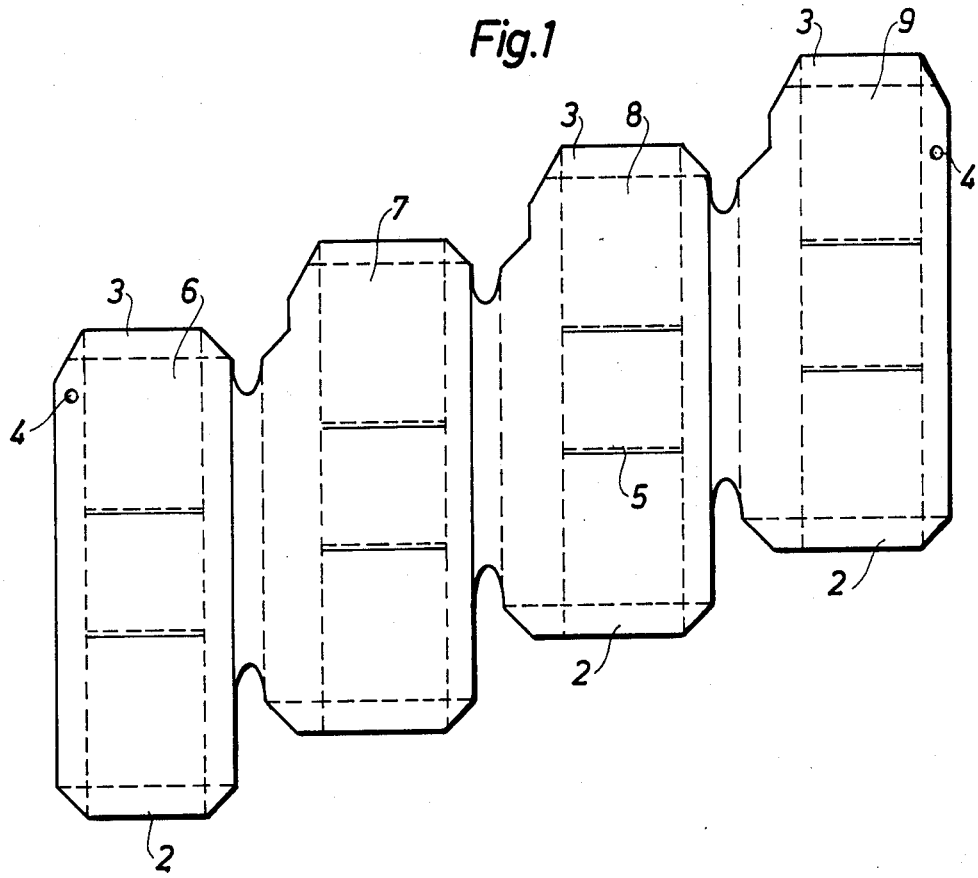
FIG. 1 is a planar view of a printing plate in accordance with a preferred embodiment of the invention.

It is easy on a drawing to indicate exactly the printing decoration for a number of package blanks arranged side by side even if these are to be displaced in relation to one another and it is also easy to transfer text and markings from such a drawing to a coherent printing plate, the position of the individual decorations in relation to one another being accurately defined. Thereafter the printing plate can be edge-cut in the manner as shown in FIG. 1 where a number of partial printing plates 6, 7, 8 and 9 can be distinguished, each of which is of substantially square shape (with the exception of rounded portions and rounded corners). The printing plate parts 6, 7, 8 and 9 thus hang together as a unit and they are of the same length. Each of the printing plate parts presents front edges 3 and rear edges 2 and so-called steering holes 4 which are used to achieve an exact placing of the printing plates on the carrier cylinder. The length of each partial printing plate is such that it corresponds to, or slightly exceeds, the circumference of the carrier cylinder onto which the printing cylinder is to be mounted while the combined width of the printing plate parts corresponds to the width of the said carrier cylinder.

Figure 2:
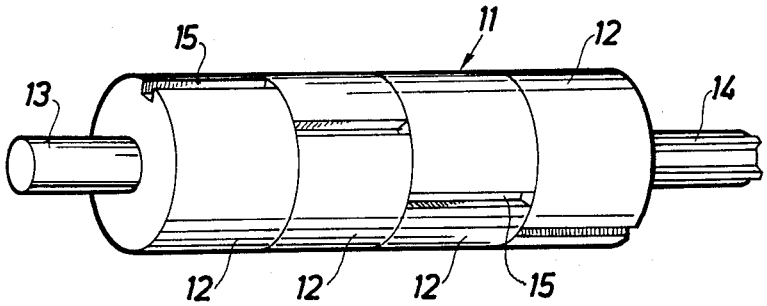
FIG. 2 is a perspective view of a carrier cylinder in accordance with a preferred embodiment of the present invention.
Figure 4:
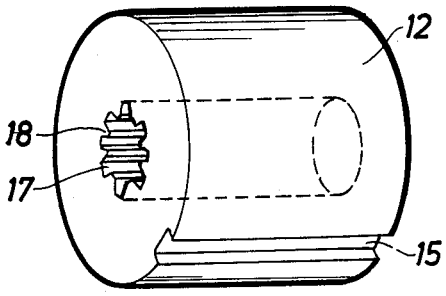
FIG. 4 is a perspective view of a partial cylinder of the carrier cylinder of FIG. 2.

Referring to FIG. 2, the carrier cylinder 11 consists of a cylinder which is mounted on an axle 13. In the preferred embodiment, the cylinder comprises of a number of separate elements 12 which are threaded onto the axle 13 in such a manner that the cylinder elements 12 are fixed in their position in relation to the axle 13. This is achieved as shown in FIG. 4 by providing the center holes 17 of the partial cylinders 12 with longitudinal ridges which can be fitted into grooves 14 on the axle 13 on the carrier cylinder 11. The partial cylinders 12 thus can be mounted on the axle 13 in mutually displaced positions which are determined by the pitch between the grooves 14 and the ridges 18. The cylinder parts 12 are provided, moreover, with holding grooves 15 in which the printing plates are retained when they are mounted on the cylinder. As is evident from FIG. 2 the partial cylinders 12 are mounted on the axle 13 in such a manner that the grooves 15 are displaced in relation to one another and this displacement corresponds to the desired displacement between parts of the printing plates.

Figure 5:
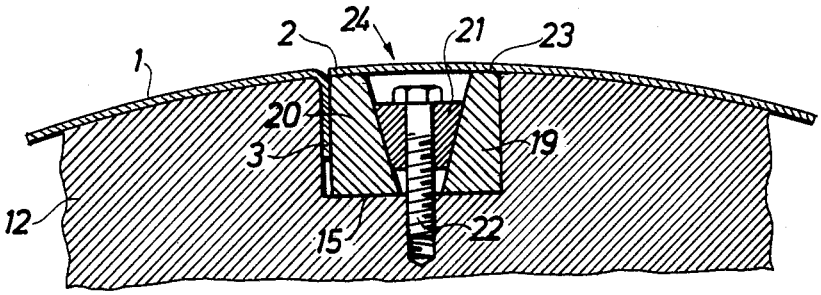
FIG. 5 is a detailed view in cross-section of the attachment of the printing plate to the carrier cylinder.

Referring to FIG. 5, the mounting is done in such a manner that the front edges 3 of the printing plate parts 6, 7, 8 and 9 are introduced into the grooves 15 in which is also introduced a holding device consisting of movable, wedgelike heels 19, 20 and one or more wedgelike elements 21 introduced between the heels which are fastened down with the help of a screw 22 between the heels 19, 20 so that the latter are pressed out against the side edges of the groove 15, so that the front edge portion 3 of the printing plate parts introduced is pressed home and is retained in fixed position. The printing plate 1 is made to surround the carrier cylinder 11, the rear edge 2 of the printing plate parts 6, 7, 8, 9 being thus located over the upper plane end surface of the holding device 24 which is level with the surface of the carrier cylinder. The length of the printing plate parts is adapted so that it therefore corresponds to the circumference of the carrier cylinder, except for the part of the printing plate which is used up for fastening in the holding device 24. The ends of the rear printing plate edge 2 will thus join up to the front edge of the printing plate and the rear edge parts 2 are fixed to the upper surface 23 of the holding device 24 with the help of an adhesive or e.g., a double-adhesive tape.

Figure 3:
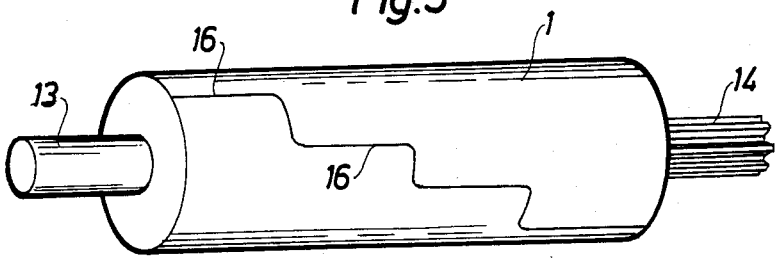
FIG. 3 is a perspective view of the carrier cylinder of FIG. 2 with printing plate of FIG. 1 fitted.

The finished printing cylinder as illustrated in FIG. 3 and it can be seen that after mounting on the carrier cylinder the front and rear edges of the printing plate 1 have been made to join up along a stepped line 16 which extends alongside the printing cylinder.

It has been found that the arrangement in accordance with the invention is very practical and can bring about great savings, since it need never be feared that the individual printing plate parts are fitted imperfectly in relation to one another and the stepped attachment of the printing plate has been found to provide a secure attachment.

Owing to the fact that the partial cylinders of the carrier cylinder with their holding groove can be displaced in relation to one another with very great accuracy it is possible to achieve high precision in the mounting of the printing plate.

It is to be understood that the present invention may be embodied in other specific forms without departing from the spirit or essential characteristics of the present invention. The preferred embodiment is therefore to be considered illustrative and not restrictive. The scope of the invention is indicated by the appended claims rather than by the foregoing descriptions and all changes or variations which fall within the meaning and range of the claims are therefore intended to be embraced therein.

What is claimed is:

1. A printing plate for offset printing comprising a plurality of printing patterns having similar outer contours, said printing patterns located on the printing plate parallel to one another and adjoining one another but displaced in a longitudinal direction in relation to one another, the printing plate being one piece and having a width which corresponds with a combined width of the individual printing patterns, the printing plate being provided along both its front edge and its rear edge with stepped edge contours so as to define a plurality of generally rectangular parts longitudinally displaced from one another, each part having a length at least as long as a length of one of the printing patterns.

2. A printing apparatus for offset printing comprising a carrier cylinder and a printing plate arranged on the carrier cylinder, said printing plate comprising a plurality of printing patterns having similar outer contours, said printing patterns located on the printing plate parallel to one another and adjoining one another but displaced in a longitudinal direction in relation to one another, the printing plate being one piece and having a width which corresponds with a combined width of the individual printing patterns, the printing plate being provided along both its front edge and its rear edge with stepped edge contours so as to define a number of generally rectangular parts longitudinally displaced from one another, each part having a length at least as long as a length of one of the printing patterns, each of said printing plate parts being arranged circumferentially around the carrier cylinder so that the carrier cylinder is surrounded by said printing plate parts, the front edge of the printing plate parts being received by a holding device arranged within the circumferential contour of the carrier cylinder, the holding device presenting a top surface which at a holding position of the holding device is located level with an outer surface of the carrier cylinder, the rear edge of the printing plate parts affixed to the top surface of said holding device.

3. The printing cylinder in accordance with claim 2, wherein said carrier cylinder has a plurality of circumferentially displaced longitudinal grooves adapted to receive the front edges of the printing plate parts, the holding device comprising two heels and a wedge-like element arranged in each longitudinal groove of the carrier cylinder, said wedge-like element positioned between said two heels, whereby said wedge-like element urges said two heels away from each other so that each one of the front edges of the printing plate parts is clamped between one of said two heels and an opposing wall of one of said grooves.

4. The printing cylinder in accordance with claim 3, wherein the carrier cylinder comprises a plurality of partial cylinders arranged on a common axle, each partial cylinder being connected to said common axle by a splined connection fixing the partial cylinders in position relative to one another and to the axle.

5. The printing cylinder in accordance with claim 2, wherein the outer surface of the carrier cylinder is fully covered by the printing plate, the front and rear edge parts of the printing plate parts forming a stepped line of connection extending longitudinally along the surface of the carrier cylinder.

6. The printing cylinder in accordance with claim 2, wherein the rear edge of the printing plate parts is fixed to the top surface of the holding part by a double-adhesive tape.

7. The printing cylinder in accordance with claim 2, wherein the cylinder comprises a plurality of partial cylinders, each partial cylinder being connected to said common axle with a splined connection fixing the partial cylinders in position in relation to one another and to the axle.

8. A printing device capable of repetitiously printing a plurality of printing patterns adjacent one another and longitudinally displaced from one another by a predetermined distance, said printing device comprising:

a printing plate having a plurality of generally rectangular plate portions adjacent one another and longitudinally displaced from one another according to the predetermined distance, each rectangular plate portion including a forward folded edge zone and a rear edge zone, said printing plate being formed into a cylinder so that said rectangular plate portions extend circumferentially with the rear edge zones placed adjacent the forward edge zones, the forward folded edge zones extending radially inwardly;

a cylinder assembly comprising an axle and a plurality of partial cylinders arranged coaxially on said axle, each partial cylinder having a longitudinal groove along its outer surface for receiving a folded edge zone and being provided with clamp means for securing a folded edge zone to said partial cylinder, said clamp means located within said longitudinal groove, said clamp means including a longitudinal member having a top surface receiving said rear edge portion, each partial cylinder receiving one of said generally rectangular plate portions, said axle and each partial cylinder being independently coupled together by a splined connection so that said partial cylinders may be angularly displaced from one another in conformity with the longitudinal displacement between said generally rectangular plate portions.

* * * * *